United States Patent [19]

Slaw, Sr.

[11] Patent Number: 4,972,537

[45] Date of Patent: Nov. 27, 1990

[54] ORTHOGONALLY COMPOSITE PREFABRICATED STRUCTURAL SLABS

[76] Inventor: Robert A. Slaw, Sr., Hemlock Trail, R.D. 4, Lehighton, Pa. 18235

[21] Appl. No.: 361,344

[22] Filed: Jun. 5, 1989

[51] Int. Cl.[5] ..... E01D 7/00

[52] U.S. Cl. ..... 14/1; 14/73

[58] Field of Search ..... 14/1, 6, 73; 404/34, 404/40, 43, 45, 70; 52/126.5, 126.7, 251, 259, 483, 601, 745, 747; 264/35, 274, 275, 277

[56] References Cited

U.S. PATENT DOCUMENTS

| | | | |
|---|---|---|---|
| 3,484,999 | 12/1969 | Van Der Lely | 52/601 X |
| 3,879,914 | 4/1975 | Haller et al. | 52/745 |
| 3,918,222 | 11/1975 | Bahramian | 52/745 X |
| 4,387,544 | 6/1983 | Schilger | 52/601 X |
| 4,594,833 | 6/1986 | Mieyal | 52/601 X |
| 4,605,336 | 8/1986 | Slaw, Sr. | 404/6 |

*Primary Examiner*—Ramon S. Britts
*Assistant Examiner*—Matthew Smith
*Attorney, Agent, or Firm*—Thomas E. Sterling

[57] ABSTRACT

This invention involves a composite prefabricated deck panel and method of construction. The panel is comprised of a rectangular frame made of steel channel members, a number of structural steel members (I-beams) extending longitudinally through the frame and a reinforcing steel mesh welded to the structural steel members. A concrete topping slab is cast over the top flanges of the rectangular structural steel frame leaving a portion of the channel members and structural members extending outwardly. This construction develops a composite action between the structural steel members and concrete.

Locking holes extend through the structural steel members, to accomodate a locking bar which attaches to a locking loop secured to supporting girders. Liquid grout is then pressure forced into locking holes which hardens to produce a rigid composite structure consisting of the panels and girders.

10 Claims, 3 Drawing Sheets

ORTHOGONALLY COMPOSITE PREFABRICATED STRUCTURAL SLABS

PRIOR ART STATEMENT

The inventor knows of the following United States patent related to this invention: U.S. Pat. No. 4,605,336. The inventor is not withholding any other known prior art which he considers anticipates this invention.

BACKGROUND OF THE INVENTION

1. Field of the Invention:

This invention relates in general to structural members and methods of fabricating structural members. More specifically it relates to, but is not limited to, structural members that are used as slabs, and the method of fabricating and fastening these members to other parts of the structure.

2. Description of the Prior Art:

In the construction of slabs for bridges or buildings, there are a wide variety of methods and materials in use. The most commonly used method is to form or construct the slabs in their final position in the structure. Usually this involves placing a slab of concrete over a grid or framework of steel o concrete structural members. In order to conserve materials the steel and concrete are connected at their interface with mechanical connectors so that they act together to resist the applied loads. This method of using materials and structural components that act together is called composite construction.

A wide variety of prefabricated structural members have been developed for use in structural slabs. Most of these are fabricated from portland cement concrete, and may be conventionally reinforced with steel bars or prestressed using prestressing steel developed for this purpose. Many of the prefabricated panels used as slabs in buildings or bridges utilize a cast-in-place portland cement concrete topping over the panels. This cast-in-place topping normally bonds to the precast slab to form a one directional composite slab. An additional reason for using a cast-in-place topping is to provide a smooth and/or level surface on the top of the panels.

There are several problems with prefabricated panels used to construct a floor slab for buildings, or a deck slab for bridges. One of these is the difficulty in obtaining a smooth and/or level surface at the joints between adjacent panels. This difficulty can usually be overcome by using a cast-in-place concrete topping, but this cast-in-place topping greatly increases the time required to construct the slab and place it in service. This time factor is extremely important in the replacement of existing in-service bridge decks. When a cast-in-place topping is not used, the top surface of the slab is usually irregular at the joints between slabs, or the cost of leveling or fastening the slabs is greatly increased due to the time and materials required to level the panels.

Another problem associated with the prefabricated panels currently in use is the difficulty in developing composite action between the panels and the main supporting beam and girders of the structure. This composite action is beneficial since it increases the load carry capacity of existing structures, and reduces the sizes of the structural members in new construction. An additional benefit of composite action is the increase in stiffness of the floor or deck system which in turn reduces the displacements due to loads placed on the slab. A further benefit is a reduction of vibrations in the floor or deck with a corresponding increase in the useful life of the slab.

There are several significant advantages gained in the use of precast slab panels in the construction of bridges and buildings. The most significant of these is the savings in construction time and labor which greatly reduces the cost of the structure. When it is necessary to replace the deck slab of existing in-service bridges, the use of precast panels greatly reduces the time that the bridge must be closed to traffic. With properly designed panels and a well organized construction sequence it is possible to replace portions of the deck slab at night or during weekends when interruption to traffic does not cause a major problem.

Another advantage of precast panels is the high quality of concrete that can be produced in the controlled conditions of the fabrication plants. Quality of concrete is affected by the mixing, transporting, placing and curing of the material in its plastic state. It is well known in the construction industry that concrete cast-in-place under field conditions is generally lower in quality and strength than a similar concrete cast in a fabricating plant. It is also understood that the concrete at the bottom of a structural member is more dense and durable than the concrete cast on the top surface. Therefore it is advantageous to cast panels used in slabs in the inverted position.

The object of the present invention is to provide an improved method of constructing slabs for buildings and bridges. In particular it is the object of the present invention to provide precast panels with a durable concrete surface that will act with partially embedded steel structural members t transfer loads to the main beams of the structure, and to also provide a method of connection to the main beams or girders that will produce composite action between these beams or girders and the precast panels. It is also an object of the present invention to provide a method that is low in cost and results in superior structural performance and reduced maintenance.

SUMMARY OF THE INVENTION

In accordance with the object of the present invention, a new method of fabricating and connecting precast concrete panels is provided. These panels consist of a framework of standard structural steel members fastened together to provide a structural framework on top of which a concrete slab is cast. The steel framework is partially embedded in the concrete slab. The perimeter of the structural steel framework consists of members with cross sections that are channel shaped. Standard double flanged steel I-beams are placed at uniform spacing between the two perimeter channels in the long direction of the panels. Holes are provided in the webs of both the channels and I-beams to provide for connections to the main supporting beams of the structure and to permit connection between adjacent panels. The structural steel members are connected to each other by means of welds or bolts to form the structural steel framework.

Prior to casting concrete on the steel framework, a mesh of steel reinforcement is welded to the top flanges of the members in the steel framework. This steel mesh is designed to reinforce the concrete that will be cast on the top of the steel framework. The mesh may be constructed from steel wires or standard deformed steel reinforcing bars. After the mesh is fastened to the top flanges, the concrete is cast to form the top of the panel, creating a structural member that exhibits composite action between the concrete and the structural steel framework. The concrete is cast while the steel framework is in the inverted position so that the top of the finished slab is on the bottom of the mold used in the casting operation. Concrete in the panels does not encase the full depth of the structural steel members in the framework. After the casting operation is completed the top flange of the structural members and the reinforcing mesh are approximately at the mid-depth of the concrete. This allows the bottom portion of the structural members to be exposed and permits utilization of this portion of the slab for connection to the main girders of the structure and to adjacent panels. In addition, this inverted method of casting results in the more durable concrete to be located at the top surface of the completed panel. Also this inverted method of casting the concrete allows a wide variety of finishes to be applied to the top surface of the concrete by using different liners on the concrete form.

After the concrete has gained sufficient strength under controlled curing conditions, the forms are removed and the panels are rotated to their upright position. Lifting devices are provided in the panels to permit handling and erection of the panels in a convenient manner. The size of the panel is controlled by the dimensions of the structure in which they will be used, and for economical and structural reasons the panels are designed to be continuous over several or all of the main supporting beams or girders. The precast panels are placed on the structure so that the long members of the steel framework are perpendicular to the main beams or girders.

In order to provide composite action between the panels and the main supporting beams or girders a connection between these two members is made utilizing a modified BAR-LOK TM type connection as described in U.S. Pat. No. 4,605,336 issued to the inventor in 1986.

In this present invention, the BAR-LOK TM connection is utilized by different methods depending on the type of main supporting girders. When the girders are made from concrete, loops of reinforcing steel are allowed to protrude from the tops of the girders. The precast panels are set on the tops of the girders, and a locking bar is placed through the loops and holes in the webs of the structural steel members of the panel. Grout is then injected through holes provided in the tops of the panels, locking the two structural elements together and allowing them to act together to resist the applied loads.

When the precast panels are used to form a slab on a structure with steel girders, threaded studs are attached to the tops of the girders and steel bars are fastened to the studs using standard nuts. This combination of studs and steel bars form loops through which the locking bar is placed. The connection is completed by placing grout in the same manner as described above for the concrete girders.

When necessary, corrosion protection can be provided for the structural steel elements in the slabs and the reinforcing mesh or bars in the con crete. This is achieved by galvanizing the entire framework after the reinforcing mesh has been welded to the structural steel. Corrosion resistance is necessary for panels that are used in bridge decks and are exposed to weather and deicing chemicals.

Additional objects of the invention are listed below:

It is an object of this invention to provide an economical, simple, and extremely rapid method and process for the coupling of a precast deck with these steel or concrete beams or stringers by using the BAR-LOK TM jointure system.

It is still another object of this invention to provide a vehicle-ready surface with extreme durability and skid-resistant texture, by casting the BAR-LOK TM panel surface-side down, with a textured liner. This casting procedure inherently brings superior concrete to the surface side.

It is yet another object of this invention to provide special concrete mix for the surface layer to decrease permeability and durability.

It is also an object of this invention to provide a joint made of reinforcing steel hoops, loops, hairpins or the like that are locked by another reinforcing bar or pin placed in an approximate perpendicular direction to the structural steel grid member.

It is still another object of this invention to provide a concrete joint which further locks by grout pressure-pumped into the void surrounding the locking bar system.

It is yet another object of this invention to provide a process which utilizes the strength of grout plus the strength of a locking reinforcing bar.

It is another object of this invention to provide a composite action between the bridge stringers and the BAR-LOK TM precast deck.

It is still another object of this invention to provide a BAR-LOK TM precast concrete deck system that can handle vehicular traffic within hours.

It is yet another object of this invention to provide a precast concrete deck panel that can be joined to another precast concrete deck panel by coupling the structural steel members that have been cast into the panel.

It is still another object of this invention for the bolts attached to the structural steel framework of the precast panel to provide adjustability to the panel surface thereby attending to irregularities in the height of the structural steel/prestressed beams.

BRIEF DESCRIPTION OF THE DRAWINGS

These and other objects of the invention are set forth in conjunction with the accompanying specification, claims, and drawings, in which:

DETAILED DESCRIPTION

Figure 1:
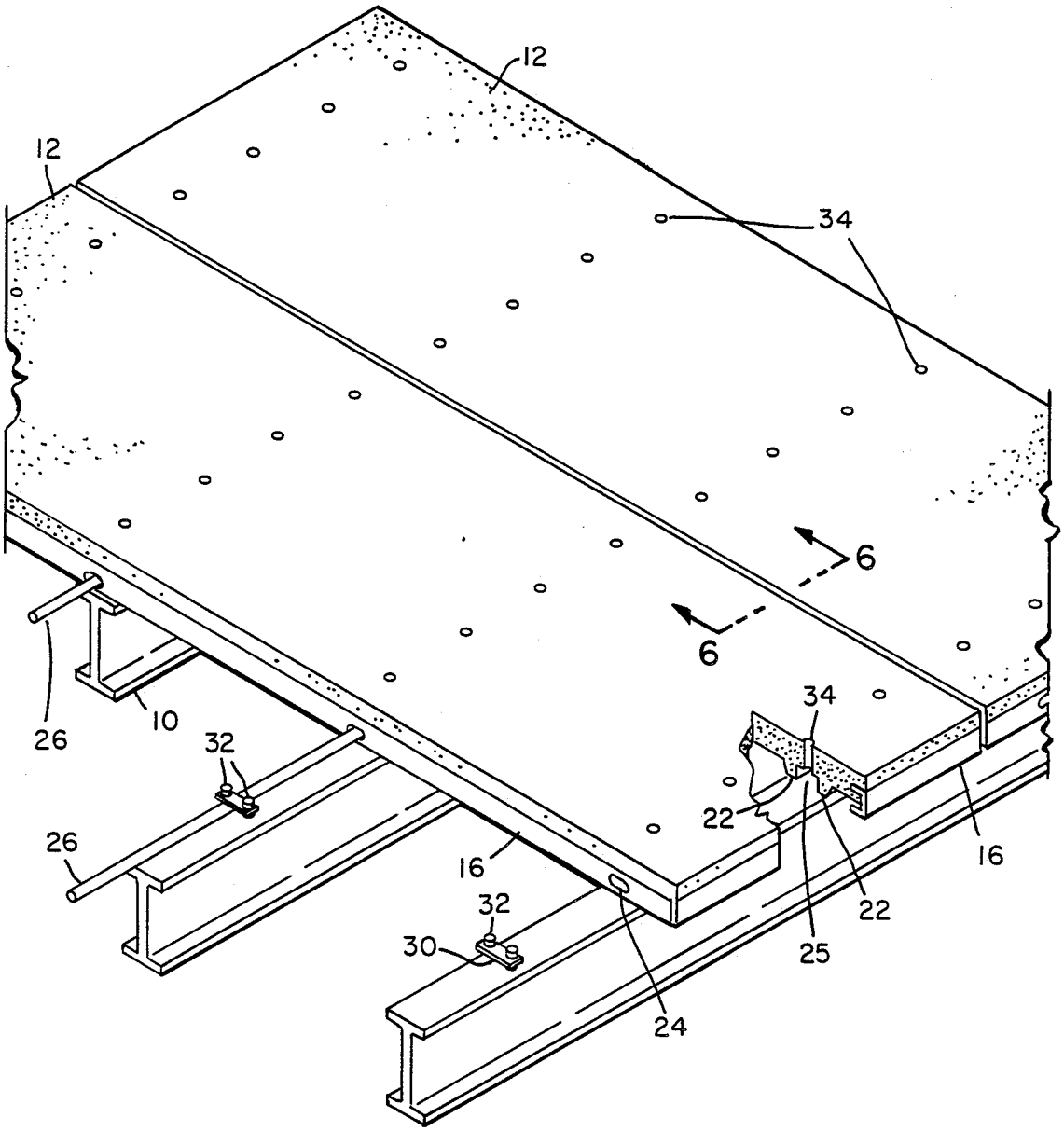
FIG. 1, is a perspective and third dimensional view, partially in section, of the invention consisting of two prefabricated panels resting on girders which are the main support structures of a bridge or other structure.
Figure 2:
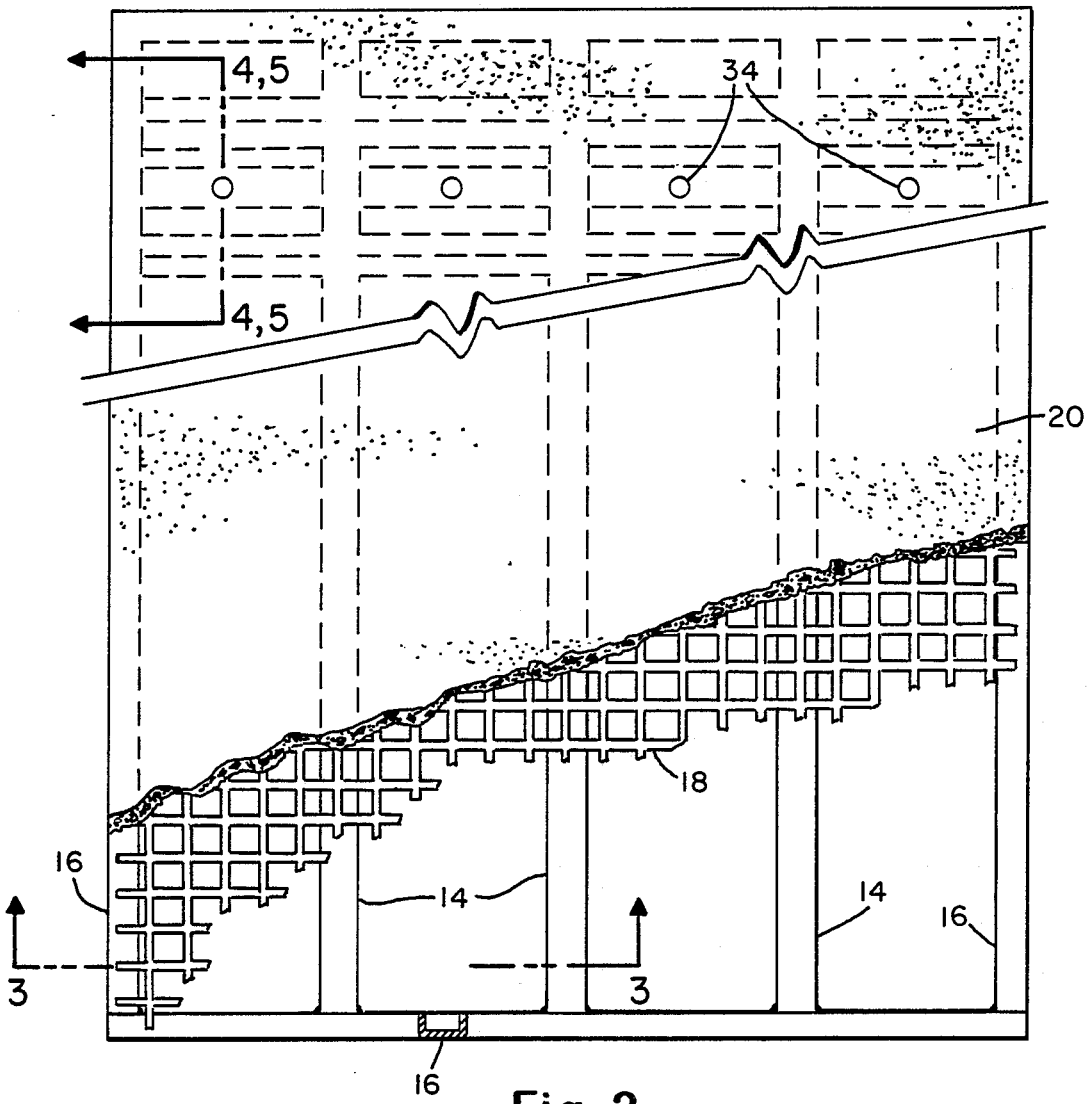
FIG. 2, is a broken top view of a single panel, partially in section, shown in FIG. 1.
Figure 3:
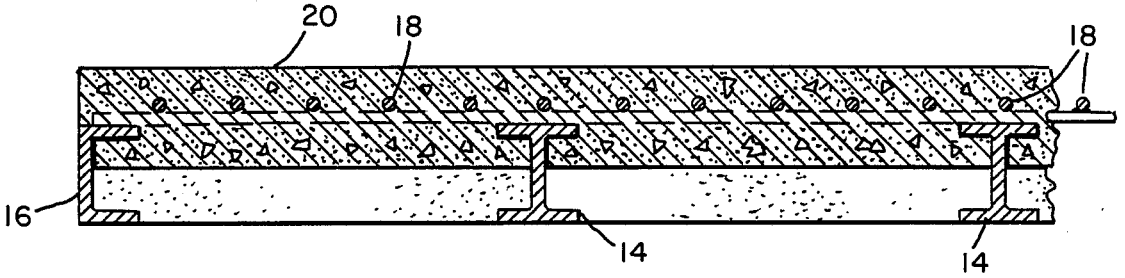
FIG. 3, is a cross-sectional view of section 3—3 of FIG. 2.

Referring now to the drawings and in particular to FIGS. 1, 2 and 3, 10 represents steel girders running longitudinally along a bridge span, approximately in the direction of the flow of traffic. Panels 12 are positioned perpendicular to the girders 10 and abutting one another. The panels 12 are comprised of a framework comprised of structural steel I-beams 14 running approximately perpendicular to the girders 10 and approximately parallel to one another. The outer frame of panel 12 is rectangular in shape and comprised of C-shaped channel members 16 which are welded together and welded to longitudinally positioned I-beams 14 extending within the outer frame. There is steel mesh 18 comprised of reinforcing bars or welded wire fabric which is welded to the I-beams 14 and channel members 16. A concrete topping 20 is poured while the panel 12 is in the inverted position so as to encase the steel mesh 18 and extend approximately half of the height of both I-beams 14 and channel members 16. Two concrete shoulders 22 are cast therein and extend outwardly from the concrete topping 20 to the position of the girders 10 and are designed to rest upon the girders 10. A flexible sealer 23 (FIGS. 4 and 5) is positioned between each shoulder 22 and the girder 10. These flexible sealers 23 extend the length of the girder 10. They are comprised of a plastic moisture resistent substance which seals the area between shoulders 22 against leakage of liquid grout 35 which is pumped in later.

Figure 4:
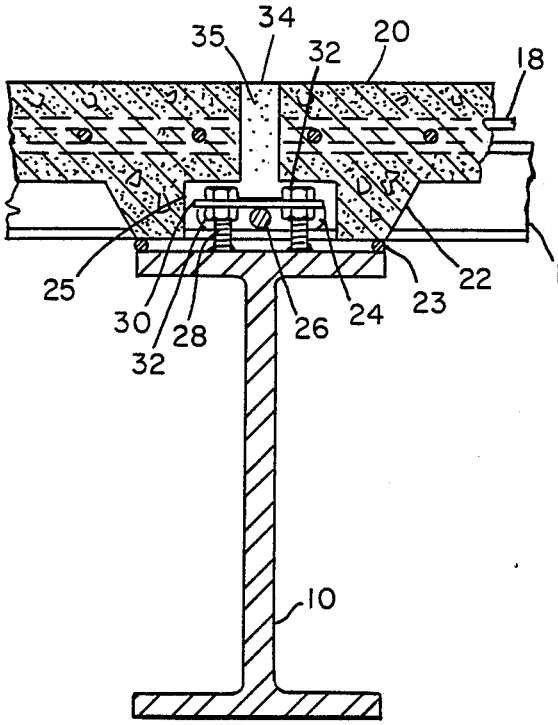
FIG. 4, is a cross-sectional view taken along lines 4—4 of FIG. 2.
Figure 5:
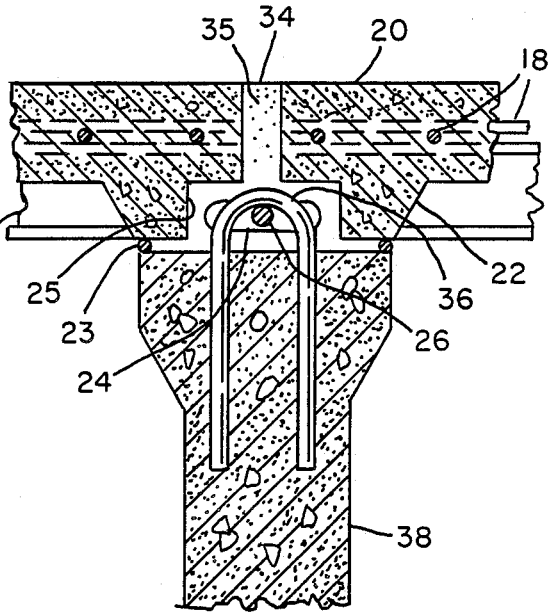
FIG. 5, is a modification of the cross-sectional view taken along lines 4—4 of FIG. 1, showing a concrete girder or beam instead of a steel one.

Referring now to FIGS. 4 and 5, locking holes 24 are drilled through the webs of the I-beams 14 and C-shaped channel members 16 directly above the position of the girders 10 and in a straight line. These locking holes 24 may be circular, oval or another shape, and are positioned to receive a locking bar 26 which extends through all of the locking holes 24 of the I-beams 14 and channel members 16 above the girders 10.

Referring now to FIG. 4, the top flange portion of each girder 10 has two threaded studs 28 extending vertically therefrom and welded to the top flange of the girder 10. A locking plate 30 with holes therein is positioned on the threaded studs 28 with locking nuts 32 on either side thereof holding the locking plate 30 directly above the locking holes 24. This same construction is made on the top flange portion of girder 10 wherever the I-beams 14 cross it and is designed so that a locking bar 26 may be inserted under the locking plates 30 and completely through the breadth of the panel and the breadth of adjacent panels if any. A grout hole 34 is cast in the concrete topping 20 directly above the locking bar 26 and serves as an entrance hole for liquid grout 35 to be pressure pumped into locking hole 24 and the passage 25. Flexible sealers 23 between shoulders 22 and girder 10 prevents liquid grout 35 from leaking out.

A modification of this invention is seen in FIG. 5 utilizing a concrete girder 38 instead of a steel girder 10 of FIG. 4. In this case a U-shaped locking loop 36 is anchored into the concrete girder 38 so as to extend through locking hole 24 to form a locking loop 36 therein. Locking bars 26 are inserted through locking holes 24 and through the locking loop 36, thus securing the concrete girder 10 to the I-beams 14 and channel members 16. A grout hole 34 in concrete topping 20 is cast so as to extend from the surface into the locking hole 24 and its adjacent passages.

In operation, the completed panels 12 are placed upon the girders 10 which already have threaded studs 28 locking plate 30 and locking nuts 32 positioned thereon. The concrete shoulders 22 are thus positioned to rest upon the tops of girder 10 with flexible sealers 23 in between. The grout hole 34 is positioned above and through the concrete topping 20. When all of the locking bars 26 have been positioned properly in the locking holes 24, liquid grout 35 is forced through each grout hole 34 under pressure so that it fills the locking hole 24 and the passage 25 adjacent to the length of the locking bar 26. By pumping liquid grout 35 in each hole and waiting for it to fill all passages 25, the grout will appear in the adjacent locking hole 24. This process can be continued throughout the entire length of locking bar 26 until the entire volume is filled with liquid grout 35. When the liquid grout 35 is hardened, the locking bars 26 and adjacent areas are protected from corrosion, held in a very rigid position, and making the panels 12 act as a single unit.

Referring now to FIG. 5, utilizing the concrete girder, a similar procedure is used. In this modification, the panels 12 are positioned on top of concrete girders 38 which have a locking loop 36 extending upwardly therefrom. Locking bar 26 is then run transversely through locking holes 24 of the panel 12 so as to go through each locking loop 36. This secures the concrete girder 38 to the 1-beams 14. Grout holes 34 are positioned above each locking bar 26, and join passage 25 in the concrete topping 20. As with the steel girder 10, liquid grout 35 is then forced under pressure through grout holes 34 to fill the entire locking hole 24 and passage 25 adjacent to the locking bar 26 in a manner previously described. As can be seen, when the liquid grout 35 hardens the concrete girder 38 is thoroughly locked to the I-beams 14 and the entire unit made rigid.

Figure 6:
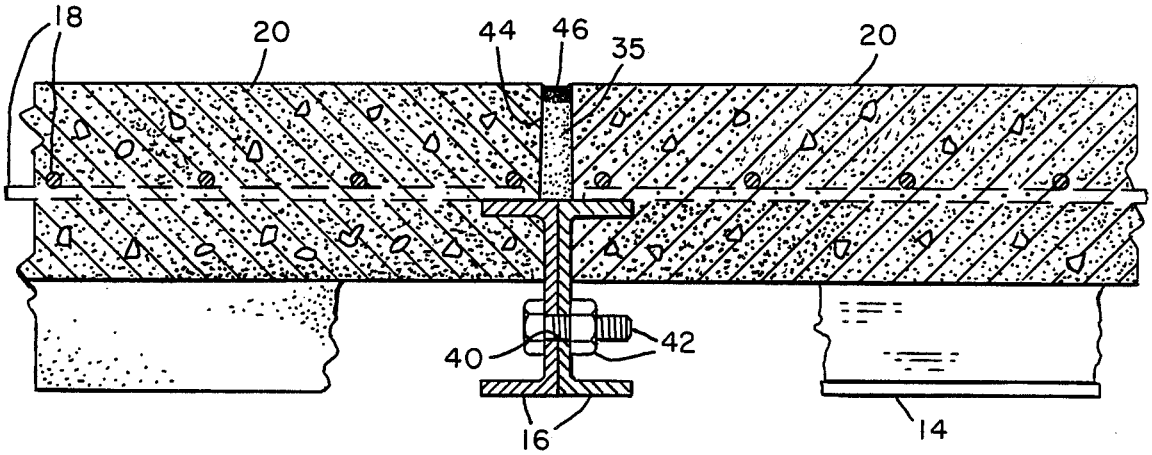
FIG. 6, is a cross-sectional view taken along lines 6—6 of FIG. 1, showing the coupling of two adjacent panels.

Referring now to FIGS. 1 and 6, it is seen that the panels 12 are positioned side by side on girders 10. The present invention provides for a method of coupling between adjacent panels hereinafter described. Referring now to FIG. 6, C-shaped channel members 16 positioned on panels 12 are abutted so that the channel members 16 lie adjacent to one another. A coupling hole 40 is then drilled through each adjacent channel member 16 and a coupling bolt and nut 42 attached. When the nut 42 is tightened, the channel members 16 are held firmly together. Coupling holes 40 are drilled at intervals of perhaps one to two feet throughout the length of the channel members 16 and coupling bolts an nuts 42 inserted and tightened. Thus as may be seen the panels 12 are securely held together on their longitudinal edge and resist the stresses and strains of bridge traffic as a unit.

A joint grout slot 44 extends through concrete topping 20 to the flange portion of channel members 16. After the channel members 16 have been coupled together with coupling bolts and nuts 42, liquid grout filler 35 is injected into joint grout slot 44 and extending the entire length of the panel 12. The grout slot 44 is filled nearly to the top and the liquid grout 35 left to harden. Following this, a joint sealer 46 is poured into the grout slot 44 on top of the liquid grout 35 (now hardened) until it is level with the top of the concrete topping 20. When this joint sealer 46 hardens, it prevents moisture or air from reaching the I-beams 14 and prevents corrosion.

It should be noted that prior to the pouring of the concrete topping 20 the panel members 12, I-beams 14 and steel mesh 18 may be rustproofed by galvanizing or with other corrosion resistance methods.

As may be seen from the preceding description, this invention constitutes a new and unique process for constructing and utilizing composite prefabricated structural panels on a girder base. The method of constructing the composite prefabricated structural panel comprises the following steps:

1. Fabricating a rectangular framework of structural steel channel members integrally fastened together.
2. Integrally attaching structural steel members longitudinally across said rectangular framework.
3. Drilling a plurality of locking holes transversely through said rectangular frame and said structural members.
4. Integrally attaching a steel reinforcing mesh to both said rectangular framework and to said structural members.
5. Inverting said rectangular framework and, with a concrete form, adding concrete topping so as to encase all of reinforcing mesh and a portion of said rectangular frame and said reinforcing members, whereby a portion of said frame and reinforcing members extend outwardly from said concrete topping.
6. Allowing said concrete topping to harden appropriately.

The method of attaching the composite prefabricated structural panel to two or more girders comprise the following steps:

1. Forming locking loops upon the portion of said girders.
2. Positioning said locking loops to extend around said locking hole.
3. Placing said now completed panel upon a girder in a position so that the concrete topping forms the upper surface of the panel.
4. Inserting a locking bar through said locking hole so as to engage said locking loops.
5. Injecting liquid grout into said locking hole and adjacent areas and allowing it to harden.

This invention has been described with a degree of specificity; however, it is understood that numerous changes in construction and design may be made without departing from the spirit of this invention.

What is claimed is:

1. A composite deck panel for use in bridges or other structures supported by two or more girders, comprising in combination:

a rectangular frame comprised of channel members integrally attached to one another;

structural members longitudinally positioned in said rectangular frame and integrally attached thereto;

reinforcing mesh integrally attached to said rectangular frame and to said structural members;

concrete topping encasing said reinforcing mesh and partially encasing said structural members and said rectangular frame, a portion of said structural members and rectangular frame entend outwardly from said concrete topping;

said structural members and said channel members having a locking hole extending through said structural members and said channel members;

a locking loop integrally attached to the upper portion of said girders and extending around said hole;

a locking rod extending through said locking hole and engaging the said locking loop welded to said girders;

said locking loop being comprised of, in combination:

threaded studs integrally attached to the upper flange portion of said girder;

a locking plate extending between said threaded studs;

locking nuts in threaded engagement with said threaded studs and positioned on either side of said locking plate.

2. The combination as claimed in claim 1, in which grout passageways are located along each girder, said passageways engaging said locking loops and said locking rods and having openings to permit liquid grout to be pumped into said passageway.

3. The combination as claimed in claim 2, in which said channel members of said rectangular frame abut one another;

a coupling bolt extends through both abutting channel members of said rectangular frame and is secured thereto by a nut;

a coupling bolt and nut securing said channel members of said rectangular frame together.

4. The combination as claimed in claim 3, in which a slotted opening extends through said concrete topping to said channel members;

grout is positioned within the lower portion of said slotted opening;

joint sealer is positioned within the upper portion of said slotted opening to the approximate level of the concrete topping.

5. The combination as claimed in claim 4, in which said structural members are comprised on steel I-beams and said rectangular frame is comprised on steel C-shaped channel members.

6. The combination as claimed in claim 5, in which concrete shoulders extend from said concrete topping and rest upon the upper surface of said girder, said shoulders providing the side portion of a grout passageway.

7. The combination as claimed in claim 6, having a plurality of locking holes, locking loops, grout holes and I-beams.

8. A composite deck panel for use in bridges or other structures supported by two or more girders and adapted to transfer load in a composite manner to structural members and to said girders, comprising in combination:

a rectangular frame comprised of channel members integrally attached to one another;

structural members longitudinally positioned in said rectangular frame and integrally attached thereto;

reinforcing mesh securely attached to said rectangular frame and to said structural members with sufficient stiffness to act with a concrete topping as an integral structural element;

the concrete topping encasing said reinforcing mesh and partially encasing said structural members to create a composite structure with said rectangular frame, a portion of said structural members and rectangular frame extend outwardly from said concrete topping;

said structural members and said channel members having a locking hole extending through said structural members and said channel members;

a locking loop integrally attached to the upper portion of said girders and extending around said locking hole, said locking loop being comprised of, in combination:

threaded studs integrally attached to the upper flange portion of said girder;

a locking plate extending between said threaded studs;

locking nuts in threaded engagement with said threaded studs and positioned on either side of said locking plate;

a rigid locking rod extending through said locking hole and engaging the said locking loop secured to said girders;

a structural element within said deck panel comprised of said structural members, rectangular frame and locking rod completely encased in grout whereby said deck panel acts as a composite structural element with said girders.

9. The combination as claimed in claim 8, in which said girders are comprised of concrete;

said locking loop is comprised of a metal loop embedded in said concrete girder, the loop portion extending outwardly from the upper portion of said girder;

a flexible seal positioned between said girders and said composite deck panel and extending the length of said girders to prevent the leaking of grout therebetween.

10. The combination as claimed in claim 9, in which grout passageways are located along each girder, said passageways engaging locking loops and locking rods and having openings to permit liquid grout to be pumped into said passageway to form a composite structural element.

* * * * *